US006325833B1

(12) United States Patent
Berlowitz et al.

(10) Patent No.: US 6,325,833 B1
(45) **Date of Patent: *Dec. 4, 2001**

(54) EMULSION BLENDS

(75) Inventors: Paul J. Berlowitz, E. Windsor, NJ (US); Robert J. Wittenbrink, Baton Rouge, LA (US)

(73) Assignee: Exxon Research and Engineering Company, Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/928,239

(22) Filed: Sep. 12, 1997

(51) Int. Cl.[7] ..... C10L 1/32
(52) U.S. Cl. ..... 44/301; 516/71
(58) Field of Search ..... 44/301; 252/312; 516/71, 76

(56) References Cited

U.S. PATENT DOCUMENTS

| | | | | |
|---|---|---|---|---|
| 2,920,948 | * | 1/1960 | Weeks | 44/301 |
| 3,425,429 | * | 2/1969 | Kane | 137/13 |
| 3,641,181 | * | 2/1972 | Robbins et al. | 252/312 X |
| 3,819,530 | * | 6/1974 | Ratledge | 252/311.5 |
| 4,043,829 | * | 8/1977 | Ratledge | 252/311.5 |
| 4,295,859 | * | 10/1981 | Boehmke | 44/301 |
| 4,400,177 | * | 8/1983 | Cottell | 44/301 |
| 4,568,480 | * | 2/1986 | Thir et al. | 252/312 |
| 4,568,663 | * | 2/1986 | Mauldin | 585/733 |
| 4,604,188 | * | 8/1986 | Yan et al. | 44/301 |
| 4,618,723 | * | 10/1986 | Herrington | 585/638 |
| 4,793,850 | * | 12/1988 | Koester et al. | 71/79 |
| 4,877,414 | * | 10/1989 | Mekonen | 44/301 |
| 4,880,760 | * | 11/1989 | Pellet et al. | 502/67 |
| 4,906,351 | * | 3/1990 | Pellet et al. | 585/640 |
| 5,019,543 | * | 5/1991 | Davis et al. | 502/64 |
| 5,292,989 | * | 3/1994 | Davis | 585/751 |
| 5,348,982 | * | 9/1994 | Herbolzheimer et al. | 518/700 |
| 5,378,348 | * | 1/1995 | Davis et al. | 208/27 |
| 5,545,674 | * | 8/1996 | Behrmann et al. | 518/715 |
| 5,660,714 | * | 8/1997 | Wittenbrink et al. | 585/737 |
| 5,783,618 | * | 7/1998 | Danner | 524/275 |
| 6,056,793 | * | 5/2000 | Suppes | 44/446 |

* cited by examiner

*Primary Examiner*—Margaret Medley
(74) *Attorney, Agent, or Firm*—Jay Simon

(57) ABSTRACT

Emulsion blends are provided containing Fischer-Tropsch hydrocarbons, non-Fischer-Tropsch hydrocarbons, water, and a surfactant.

11 Claims, 1 Drawing Sheet

EMULSION BLENDS

FIELD OF THE INVENTION

This invention relates to emulsions comprising Fischer-Tropsch derived liquids and hydrocarbon liquids other than Fischer-Tropsch liquids, e.g., petroleum liquids, and water.

BACKGROUND OF THE INVENTION

Hydrocarbon in water emulsions are well known and have a variety of uses, e.g., as fuels for power plants or internal combustion engines. These emulsions are generally described as macro-emulsions, that is, where the emulsion is cloudy or opaque as compared to micro-emulsions that are essentially clear, translucent, and more thermodynamically stable than macro-emulsions, the micro-emulsions having a higher level of surfactant.

While aqueous fuel emulsions are known to reduce pollutants when burned as fuels, the methods for preparing emulsions and the materials used therein, e.g., surfactants and co-solvents, such as alcohols, can be expensive Also, the thermodynamic stability of macro-emulsions is relatively weak, particularly when low levels of surfactants are used in preparing the emulsions.

Consequently, there is a need for stable macro-emulsions that employ less surfactants or co-solvents, and use less costly materials in preparing hydrocarbon in water emulsions. Additionally, by virtue of the invention described herein, distillate fuel emulsions of conventional petroleum fuels can be upgraded, for example, to higher cetane index, by blending with Fischer-Tropsch derived hydrocarbon liquids, e.g., distillates.

For purposes of this invention, the stability of macro-emulsions is determined generally as the degree of separation occurring during a twenty-four hour period, usually the first twenty-four hour period after forming the emulsions.

SUMMARY OF THE INVENTION

In accordance with this invention, a distillate emulsion is provided which comprises water, a Fischer-Tropsch hydrocarbon, a hydrocarbon other that a Fischer-Tropsch hydrocarbon, and a surfactant where the amount of surfactant employed is less than or equal to, preferably less than, the amount of surfactant required to emulsify either hydrocarbon by itself. Thus, a synergistic effect occurs when non-Fischer-Tropsch hydrocarbon distillates are emulsified with water in the presence of Fischer-Tropsch hydrocarbon distillates.

PREFERRED EMBODIMENTS

Figure 1:
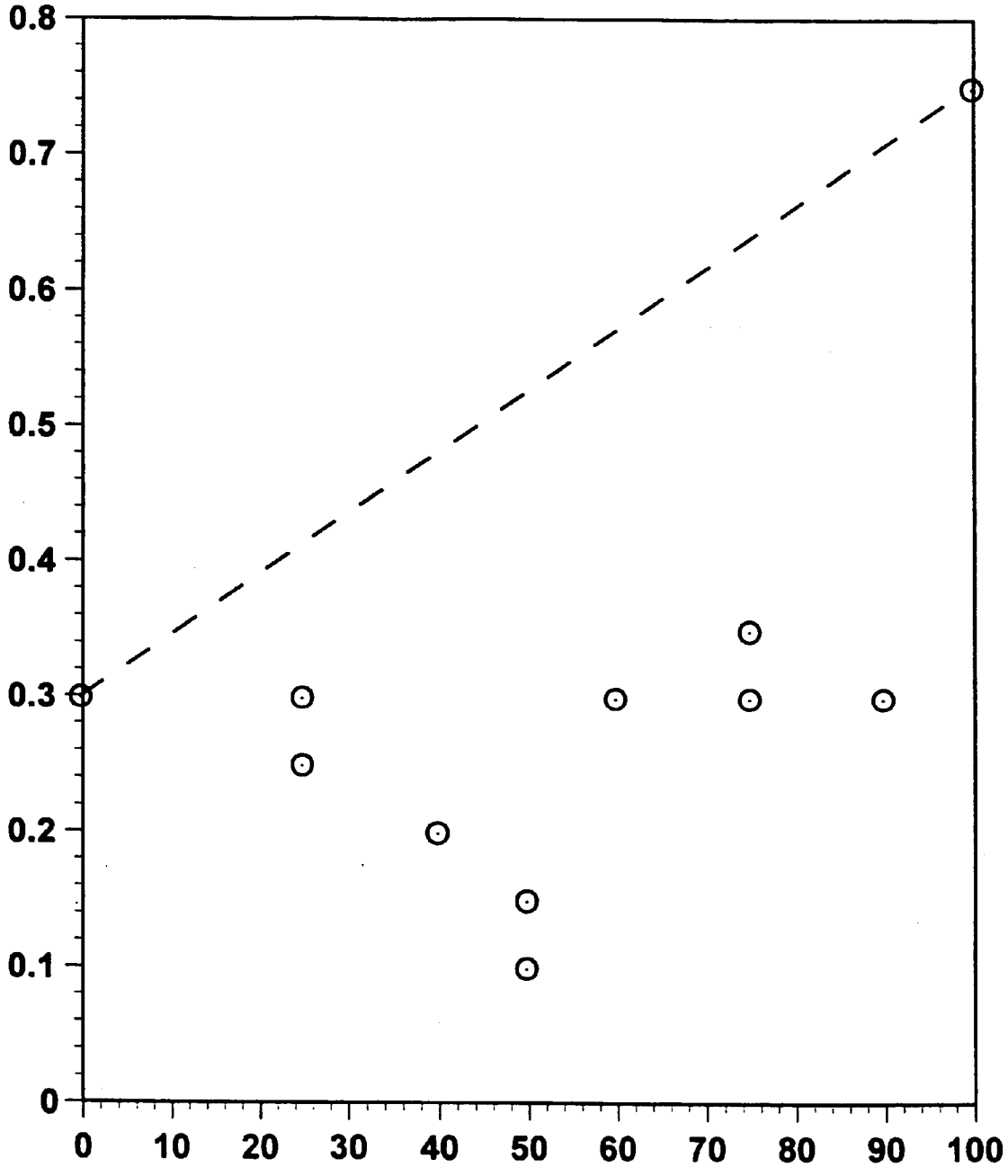
FIG. 1 is a plot of the minimum amount of surfactant required (ordinate) to emulsify blends of Fischer-Tropsch distillates and conventional petroleum distillates (abscissa).

By virtue of this invention, relatively stable, macro-emulsions are prepared in the substantial absence, e.g., ≦1.0 wt % or complete absence of the addition of a co-solvent, e.g., alcohols, and preferably in the substantial absence of co-solvent. Thus, Fischer-Tropsch liquids may contain trace amounts of oxygenates, including alcohols, these oxygenates being lower in concentration in the emulsions than would be present if an alcohol or other oxygen containing co-solvent was added to the emulsion. Generally, the alcohol content of the Fischer-Tropsch liquids is nil in the sense of not being measurable, and is generally less than about 1 wt % based on the liquids, more preferably less than about 0.1 wt % based on the liquid.

The Fischer-Tropsch liquids used in this invention are those hydrocarbons that are liquid at room temperature. Thus, these materials may be the raw liquids from the Fischer-Tropsch hydrocarbon synthesis reactor, such as $C_4$+ liquids, preferably $C_5$+ liquids, more preferably $C_5$–$C_{17}$ hydrocarbon containing liquids, or hydroisomerized Fischer-Tropsch liquids such as $C_5$+ liquids. These materials generally containing at least about 90 wt % paraffins, normal or isoparaffins, preferably at least about 95 wt % paraffins, and more preferably at least about 98 wt % paraffins.

The Fischer-Tropsch hydrocarbons may be further characterized as fuels: for example, naphthas, e.g. boiling in the range $C_4$ to about 320° F., preferably $C_5$–320° F., water emulsions of which may be used as power plant fuels; transportation fuels, jet fuels, e.g., boiling in the range of about 250–575° F., preferably 300–550° F., and diesel fuels, e.g., boiling in the range of about 320–700° F. Other liquids derived from Fischer-Tropsch materials and having higher boiling points are also included in the materials used in this invention.

The non-Fischer-Tropsch hydrocarbons can be obtained from a variety of sources, e.g., petroleum, shale liquids (kerogen), tar sand liquids (bitumen), or coal liquids. Preferred materials are petroleum derived hydrocarbons boiling in the same ranges as described for the Fischer-Tropsch hydrocarbon containing liquids.

Generally, the emulsions contain less that 100 wt % of either Flscher-Tropsch hydrocarbon containing liquids or non-Fischer-Tropsch hydrocarbons containing liquids. Preferably, however, the Fischer-Tropsch liquids are present in amounts of about 10–90 wt % of the total hydrocarbons, more preferably at least about 20 wt % Fischer-Tropsch liquids, still more preferably 25–75 wt %, and still more preferably 40–60 wt % Fischer-Tropsch liquids.

The amounts of water and total hydrocarbons in the emulsions can also vary over a wide range, for example, 90/10 hydrocarbon/water to 10/90 hydrocarbon/water. Preferably, however, the hydrocarbon content will be greater than about 50 wt %, preferably greater than about 60 wt %, more preferably 60–85 wt %.

While any kind of water may be used, the water obtained from the Fischer-Tropsch process, e.g., $$2nH_2+nCO \rightarrow C_nH_{2n+2}+nH_2O$$

is particularly preferred, the process water from a non-shifting process.

A generic composition of Fischer-Tropsch process water, in which oxygenates are preferably ≦2.0 wt %, more preferably less than 1 wt % and useful for preparing hydrocarbon emulsions is shown below:

| | |
|---|---|
| $C_1$-$C_{12}$ alcohols | 0.05–2 wt %, preferably 0.05–1.2 wt % |
| $C_2$-$C_6$ acids | 0–50 wppm |
| $C_2$-$C_6$ Ketones, aldehydes | |
| acetates | 0–50 wppm |
| other oxygenates | 0–500 wppm |

Fischer-Tropsch derived materials usually contain few unsaturates, e.g., ≦1 wt %, olefins and aromatics, preferably less than about 0.5 wt % total aromatics, and nil-sulfur and nitrogen, i.e., less than about 50 ppm by weight sulfur or nitrogen. Hydrotreated Fischer-Tropsch liquids may also be used which contain virtually zero or only trace amounts of oxygenates, olefins, aromatics, sulfur, and nitrogen.

The non-ionic surfactant is usually employed in amounts equal to or lower than that required for emulsifying petroleum derived liquids. Thus, the surfactant concentration used is sufficient to allow the formation of the macro, relatively stable emulsion. Preferably, the amount of surfactant employed is at least about 0.001 wt % of the total emulsion, more preferably at least about 0.01 wt %, still more preferably about 0.05 to about 5 wt %, and still more preferably 0.05 to less than 3 wt %, and most preferably 0.05 to less than about 3 wt %, and most preferably 0.05 to less than about 2 wt %.

Typically, surfactants useful in preparing the emulsions of this invention are non-ionic and are those used in preparing emulsions of petroleum derived or bitumen derived materials, and are well known to those skilled in the art. These surfactants usually have a HLB of about 7–25, preferably 9–15. Useful surfactants for this invention include ethoxylated alkylphenols with 5–30 moles of ethyleneoxide per molecule, linear alcohol ethoxylates, ethoxylated octylphenol, fatty alcohol ethoxylates, ethoxylated stearic acid, stearyl alcohol ethoxylates, ethoxylated dialkyl phenol, and alkyl glycosides, preferably ethoxylated alkyl phenols, and more preferably ethoxylated nonylphenols with about 8–15 ethylene oxide units per molecule. A particularly preferred emulsifier is an alkyl phenoxy polyalcohol, e.g., nonyl phenoxy poly (ethyleneoxy ethanol), commercially available from several sources, including the trade name Igepol.

The use of water-fuel emulsions significantly improves characteristics of the fuels and particularly so in respect of the materials of this invention where Fischer-Tropsch water emulsions have better emission characteristics than petroleum derived emulsions, i.e., in regard to particulate emissions and $NO_x$.

The emulsions of this invention are formed by conventional emulsion technology, that is, subjecting a mixture of the hydrocarbon, water and surfactant to sufficient shearing, as in a commercial blender or its equivalent for a period of time sufficient for forming the emulsions, e.g., generally a few seconds. For emulsion information, see generally, "Colloidal Systems and Interfaces", S. Ross and I. D. Morrison, J. W. Wiley, NY, 1988.

The Fischer-Tropsch process is well known in these skilled in the art, see for example, U.S. Pat. Nos. 5,348,982 and 5,545,674 incorporated herein by reference and typically involves the reaction of hydrogen and carbon monoxide in a molar ratio of about 0.5/1 to 4/1, preferably 1.5/1 to 2.5/1, a temperatures of about 175–400° C., preferably about 180–240° C., a pressures of 1–100 bar, preferably about 10–50 bar, in the presence of a Fischer-Tropsch catalyst, generally a supported or unsupported Group VIII, non-noble metal, e.g., Fe, Ni, Ru, Co and with or without a promoter, e.g. ruthenium, rhenium, hafnium, zirconium, titanium. Supports, when used, can be refractory metal oxides such as Group IVB, i.e., titania, zirconia, or silica, alumina, or silica-alumina. A preferred catalyst comprises a non-shifting catalyst, e.g., cobalt or ruthenium, preferably cobalt, with rhenium or zirconium as a promoter, preferably cobalt/rhenium supported on alumina, silica or titania, preferably titania. The Fischer-Tropsch liquids, i.e., $C_5$+, preferably $C_{10}$+, are recovered and light gases, e.g., unreacted hydrogen and CO, $C_1$ to $C_3$ or $C_4$ and water are separated from the hydrocarbons.

Hydroisomerization conditions for Fischer-Tropsch derived hydrocarbons are well known to those skilled in the art. Generally, the conditions include:

| CONDITION | BROAD | PREFERRED |
|---|---|---|
| Temperature, ° F. | 300–900 (149–482° C.) | 550–750 (288–399° C.) |
| Total pressure, psig | 300–2500 | 300–1500 |
| Hydrogen Treat Rate, SCF/B | 500–5000 | 2000–4000 |

Hydrocarbon consumption is a result of conditions.

Catalysts useful in hydroisomerization are typically bifunctional in nature containing an acid function as well a hydrogenation component. A hydrocracking suppressant may also be added. The hydrocracking suppressant may be either a Group 1B metal, e.g., preferably copper, in amounts of about 0.1–10 wt %, or a source of sulfur, or both. The source of sulfur can be provided by presulfiding the catalyst by known methods, for example, by treatment with hydrogen sulfide until breakthrough occurs.

The hydrogenation component may be Group VIII metal, either noble or non-noble metal. The preferred non-noble metals can include nickel, cobalt, or iron, preferably nickel or cobalt, more preferably cobalt. The Group VIII metal is usually present in catalytically effective amounts, that is, ranging from 0.1 to 20 wt %. Preferably, a Group VI metal is incorporated into the catalyst, e.g., molybdenum, in amounts of about 1–20 wt %.

The acid functionally can be furnished by a support with which the catalytic metal or metals can be composited by well known methods. The support can be any refractory oxide or mixture of refractory oxides or zeolites or mixtures thereof Preferred supports include silica, alumina, silica-alumina-phosphates, titania, zirconia, vanadia and other Group III, IV, V or VI oxides, as well as Y sieves, such a ultra stable Y sieves. Preferred supports include silica-alumina where the silica concentration of the bulk support is less than about 50 wt %, preferably less than about 35%, more preferably 15–30 wt %. When alumina is used as the support, small amounts of chlorine or fluorine may be incorporated into the support to provide the acid functionality.

A preferred support catalyst has surface areas in the range of about 180–440 $m^2$/gm, preferably 230–350 $m^2$/gm, a bulk density of about 0.5–1.0 g/ml, and a side crushing strength of about 0.8 to 3.5 kg/mm.

The preparation of preferred amorphous silica-alumina microspheres for use as supports is described in Ryland, Lloyd B., Tamele, M. W., and Wilson, J. N., Cracking Catalysts, Catalysis; Volume VII, Ed. Paul H. Emmett, Reinhold Publishing Corporation, New York, 1960.

During hydroisomerization, the 700° F.+ conversion to 700° F. –ranges from about 20–80%, preferably 30–70%, more preferably about 40–60%, and essentially all olefins and oxygenated products are hydrogenated.

The catalysts can be prepared by any well known method, e.g., impregnation with an aqueous salt, incipient wetness technique, followed by drying at about 125–150° C. for 1–24 hours, calcination at about 300–500° C. for about 1–6 hours, reduction by treatment with a hydrogen or a hydrogen containing gas, and, if desired, sulfiding by treatment with a sulfur containing gas, e.g., $H_2S$ at elevated temperatures. The catalysts will then have about 0.01 to 10 wt % sulfur. The metals can be composited or added to the catalyst either serially, in any order, or by co-impregnation of two or more metals.

To exemplify this invention several emulsions blends were prepared at room temperature, although preparation temperatures may range from about 10–100° C., preferably 15–30° C.

The surfactant was first mixed with water and blended in a Waring blender for 5 seconds. Then the hydrocarbon was added and blended for one (1) minute. If an emulsion did not form, blending was continued in one (1) minute sequences, checking for an emulsion after each minute. If an emulsion did not form after a total of five (5) minutes blending time, emulsification was not successful.

We used the following conditions:

Surfactant: Igepol CO-630 (Rhone-Poulenc); ethoxylated nonylphenol with 9 moles EO Water: Hydrocarbon ratio: 30/70

Blend amount: 200 ml

Water type: tap water

Hydrocarbons: Fischer-Tropsch diesel (250–700° F. boiling range) described below and a conventional, petroleum derived European summer grade diesel fuel. The Fischer-Tropsch diesel was prepared by converting hydrogen and carbon monoxide ($H_2$:CO 2.11–2.16) to heavy paraffins in a slurry Fischer-Tropsch reactor with a titania supported cobalt/rhenium catalyst described in U.S. Pat. No. 4,568,663. The reaction conditions were about 425° F. and 288 psig and a linear gas velocity of 17.5 cm/sec. The alpha was 0.92. The Fischer-Tropsch wax which was predominantly 500° F.+ was hydroisomerized in a flow through fixed bed unit using a cobalt and molybdenum amorphous silica-alumina catalyst as described in U.S. Pat. No. 5,292,989 and U.S. Pat. No. 5,378,348. Hydroisomerization conditions included 708° F., 750 psig $H_2$ 2500 SCF/B $H_2$ and a liquid hourly space velocity (LHSV) of 0.7–0.8. Hydroisomerization was conducted with recycle of 700° F. reactor wax. The combined feed ratio (Fresh Feed+Recycle Feed)/Fresh Feed was 1:5. The product was then fractionated and a nominal 320–700° F. cut diesel was recovered. This product contained nil sulfur, nitrogen, aromatics, oxygen (ates), and unsaturates and is essentially 100% paraffinic.

Eleven tests were prepared with Tests 1 and 11 being 100% petroleum derived diesel and 100% Fischer-Tropsch derived diesel, respectively, shown in Table I below.

TABLE I

| Test # | Petroleum Derived Diesel | Fischer-Tropsch Diesel | Surfactant |
|---|---|---|---|
| 1 | 0 | 100 | 0.3 |
| 2 | 25 | 75 | 0.25 |
| 3 | 25 | 75 | 0.3 |
| 4 | 40 | 60 | 0.2 |
| 5 | 50 | 50 | 0.15 |
| 6 | 50 | 50 | 0.1 |
| 7 | 60 | 40 | 0.3 |
| 8 | 75 | 25 | 0.35 |
| 9 | 75 | 25 | 0.3 |
| 10 | 90 | 10 | 0.3 |
| 11 | 100 | 0 | 0.75 |

This data is plotted and shown graphically in FIG. 1. From the graph, it is clear that the minimum surfactant concentration for emulsifying 100% petroleum derived diesel was 0.75 wt %, while the minimum surfactant required for emulsifying 100% Fischer-Tropsch hydrocarbons was 0.3%. The table and FIG. 1 show clearly that no more than 0.3 wt % surfactant was required to emulsify any combination of petroleum derived and Fischer-Tropsch derived hydrocarbons. Nevertheless, for the surfactant required to emulsify either hydrocarbon, we could expect the required amount of surfactant to emulsify any mixture of the two hydrocarbons to fall on or around the dotted line.

What is claimed is:

1. An emulsion comprising a hydrocarbon component comprising:

10–90 wt % of total hydrocarbons of liquid Fischer-Tropsch derived hydrocarbons;

90–10 wt % of total hydrocarbons of liquid non-Fischer-Tropsch derived hydrocarbons;

water;

an amount of a non-ionic surfactant of at least about 0.001 wt % of total emulsion, and less than the amount of non-ionic surfactant required to emulsify the liquid non-Fischer-Tropsch hydrocarbons by itself.

2. The emulsion of claim 1 wherein the liquid non-Fischer-Tropsch hydrocarbons are derived from petroleum.

3. The emulsion of claim 2 wherein the water:total hydrocarbons ranges from 90 wt % hydrocarbons:10 wt % water to 10 wt % hydrocarbons:90 wt % water.

4. The emulsion of claim 3 wherein the hydrocarbon:water is greater than about 50 wt %.

5. The emulsion of claim 4 wherein the Fischer-Tropsch hydrocarbons boil in the range $C_4$–700° F.

6. The emulsion of claim 5 wherein the Fischer-Tropsch hydrocarbons comprise 25–75 wt % of the total hydrocarbons.

7. The emulsion of claim 1 wherein the surfactant has an HLB of about 7–25.

8. The emulsion of claim 1 wherein the amount of non-ionic surfactant required is less than or equal to that required to emulsify the Fischer-Tropsch hydrocarbon by itself.

9. The emulsion of claim 5 wherein the Fischer-Tropsch hydrocarbons boil in the transportation fuels range.

10. The emulsion of claim 5 wherein the Fischer-Tropsch hydrocarbons boil in the diesel fuel range.

11. The emulsion of claim 5, 9 or 10 wherein the petroleum derived hydrocarbons boil in the same range as the Fischer-Tropsch hydrocarbons.

* * * * *